US007084377B2

(12) United States Patent
Raterman et al.

(10) Patent No.: US 7,084,377 B2
(45) Date of Patent: Aug. 1, 2006

(54) HEATED DEVICE AND METHOD OF REDUNDANT TEMPERATURE SENSING

(75) Inventors: John M. Raterman, Atlanta, GA (US); Edward C. Taylor, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/698,312

(22) Filed: Oct. 31, 2003

(65) Prior Publication Data

US 2005/0092736 A1 May 5, 2005

(51) Int. Cl.
*H05B 1/02* (2006.01)

(52) U.S. Cl. ..... 219/481; 219/497; 219/508; 392/479

(58) Field of Classification Search ..... 219/494, 219/481, 497, 499, 501, 505, 508, 509; 392/479, 392/488, 465, 466
See application file for complete search history.

(56) References Cited

U.S. PATENT DOCUMENTS 4,314,143 A * 2/1982 Bilstad et al. ..... 219/497
4,320,285 A * 3/1982 Koether ..... 219/497
4,381,075 A * 4/1983 Cargill et al. ..... 237/8 R
4,716,520 A * 12/1987 Locke, Jr. et al. ..... 364/186
4,852,544 A * 8/1989 Williams et al. ..... 126/39 BA
5,240,018 A * 8/1993 Clark et al. ..... 134/64 R
6,342,264 B1 1/2002 Raterman et al. ..... 427/8

FOREIGN PATENT DOCUMENTS

DE 20106348 9/2001

* cited by examiner

*Primary Examiner*—Mark Paschall
(74) *Attorney, Agent, or Firm*—Wood, Herron & Evans, L.L.P.

(57) ABSTRACT

A device for carrying a heated liquid, and controlling the temperature of the heated liquid includes a liquid conveying element including a passage for carrying the heated liquid. First and second temperature sensing devices are operatively associated with the liquid conveying element to sense the temperature of the heated liquid. A controller is actively connected to the first temperature sensing device. The first temperature sensing device thereby senses the temperature of the heated liquid in the passage and conveys the temperature information or readings to the controller for use in the heater control. The second temperature sensing device is capable of being actively connected to the controller upon failure or malfunction of the first temperature sensing device.

8 Claims, 3 Drawing Sheets

HEATED DEVICE AND METHOD OF REDUNDANT TEMPERATURE SENSING

FIELD OF THE INVENTION

The present invention generally relates to devices, such as hoses used to carry heated liquids and incorporating temperature sensors, such as resistive temperature detectors (RTDs).

BACKGROUND OF THE INVENTION

Various manufacturing processes involve the transmission of a heated liquid from a supply tank, through a hose, and to a liquid dispensing device which deposits the heated liquid into a container or onto a substrate. Some of the heated liquids are hot melt adhesives which solidify at room temperature. Accordingly, a hot melt adhesive must be heated and liquified so it can flow from the supply tank, through the hose, and out the liquid dispensing device. To liquify and subsequently maintain the hot melt adhesive within an appropriate temperature range, the supply tank, the hose, and the dispensing gun are selectively heated by individual heating devices operatively associated with each respective component. To monitor the temperature of the hot melt adhesive throughout the application process, each component further includes some form of temperature sensing device which operates in conjunction with at least one heating device. A controller operates the heating device in response to signals from the temperature sensing device to maintain the hot melt adhesive within a predetermined temperature range.

Generally, separate temperature controllers are provided for the dispensing gun, the hose, and the supply tank. The hose will often incorporate a single temperature sensing device, such as an RTD, and a single heating device which are coupled to a wire harness extending from one end of the hose. This wire harness has a connector which connects to a complementary connector on the controller. The controller monitors the temperature detected from the RTD and activates the heating device as necessary. The RTD may be made from different materials, such as nickel or platinum. Typically, either a nickel RTD is used with a compatible controller, or a platinum RTD is used with a different compatible controller. U.S. patent application Ser. No. 09/697,572 filed Oct. 26, 2000, and assigned to the assignee of the present invention, discloses the incorporation of both a nickel RTD and a platinum RTD into a heated hose. Through the use of an adaptor plug, this allows the hose to be operatively coupled to either of the two types of controllers in use (i.e., platinum or nickel RTD compatible controllers).

Occasionally, temperature sensing devices such as RTDs, will fail or otherwise malfunction. This leads to erroneous temperature readings or to a complete inability to detect the temperature of the intended target, such as the liquid adhesive being carried within a heated device such as a hose. In these cases, since the RTD is integrally incorporated into the heated device, the entire heated device must be disassembled from its associated system and replaced. The downtime and replacement costs can be relatively high, especially as compared to the cost of the RTD itself. It may also be some time before a defective RTD is discovered and this can result in improper heating of the adhesive for the same amount of time. If overheating of adhesive occurs, char and other negative effects of the overheating can harm the hot melt system and/or the products receiving the hot melt adhesive.

Underheating the adhesive can, for example, adversely affect adhesive properties such as bond strength.

In light of the drawbacks discussed above, it would be desirable to provide a heated device for carrying a liquid in which the heated device can automatically respond to a temperature sensor failure and/or which has redundant temperature sensing capabilities. These capabilities would provide for accurate temperature sensing in the event of sensor failure and provide for easier and less costly maintenance of the heated device.

SUMMARY OF THE INVENTION

The invention generally provides a device for carrying a heated liquid and controlling the temperature of the heated liquid which includes a redundant temperature sensing system having at least two temperature sensing devices. In the event that the first temperature sensing device fails or malfunctions, the second temperature sensing device can take over the temperature sensing function. The temperature sensing function can be switched manually by the user or automatically by a controller upon sensing the failure or malfunction. Since both temperature sensing devices are incorporated into the heated device, costly downtime and maintenance can be avoided. The heated device can, for example, be a heated hose or other adhesive carrying component of a hot melt adhesive system.

In one preferred embodiment, the invention includes a liquid conveying element including a passage for carrying the heated liquid. First and second temperature sensing devices are operatively associated with the liquid conveying element to sense the temperature of the heated liquid therein. A controller is actively connected to the first temperature sensing device and may or may not be actively connected to the second temperature sensing device. In this regard, "actively connected" means that the temperature sensing device is being used to control the temperature of the liquid conveying element. The first temperature sensing device senses the temperature of the heated liquid in the passage and communicates the sensed temperature to the controller. The second temperature sensing device is capable of being or remaining actively connected to the controller upon failure or malfunction of the first temperature sensing device, while in that case, the first temperature sensing device is deactivated. A heater is coupled with the controller and operated by the controller based on the sensed temperature readings taken by the first temperature sensing device. Upon active connection of the second temperature sensing device, the heater is controlled by the second temperature sensing device and the first temperature sensing device is deactivated.

In one aspect, the controller is configured to detect the failure or malfunction of the first temperature sensing device and provide indication thereof to an operator. The controller can be further configured to automatically switch to the second temperature sensing device after detection of the failure or malfunction of the first temperature sensing device. The controller may also cycle one or both temperature sensing devices on and off during operation of the system to, for example, continuously ensure that both temperature sensing devices are functioning properly. The first and second temperature sensing devices are preferably resistance temperature detectors, but could take other forms.

In another aspect, the invention provides a redundant temperature sensing device configured to be coupled to a device for carrying a heated liquid for sensing the temperature of the heated liquid. The redundant temperature sensing device includes a housing and first and second temperature sensing devices (e.g., RTDS) carried by the housing. The first and second temperature sensing devices each respectively couple to first and second electrical leads and are further coupled to a common electrical lead. The first temperature sensing device may be operatively coupled to the controller and the second temperature sensing device is capable of being operatively connected to the controller upon failure or malfunction of the first temperature sensing device.

A method of controlling the temperature of a liquid carried within a heated device as generally described above is also contemplated by the invention. The method includes detecting the temperature of the liquid in the heated device with the first temperature sensing device. The detected temperature is communicated to a controller. The controller adjusts a heater associated with the heated device based on the detected temperature. A malfunction or failure of the first temperature sensing device is detected and, thereafter, the temperature of the liquid is detected with the second temperature sensing device. The communicating and adjusting steps are then repeated using temperature detection information from the second temperature sensing device. Preferably, the step of detecting the malfunction or failure of the first temperature sensing device is performed by the controller. Detecting the temperature of the liquid in the device with the second temperature sensing device can be initiated automatically by the controller upon detecting the malfunction or failure of the first temperature sensing device. The controller can also indicate the detected malfunction or failure of the first temperature sensing device to an operator.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF DRAWINGS

DETAILED DESCRIPTION OF PREFERRED EMBODIMENTS

Figure 1:
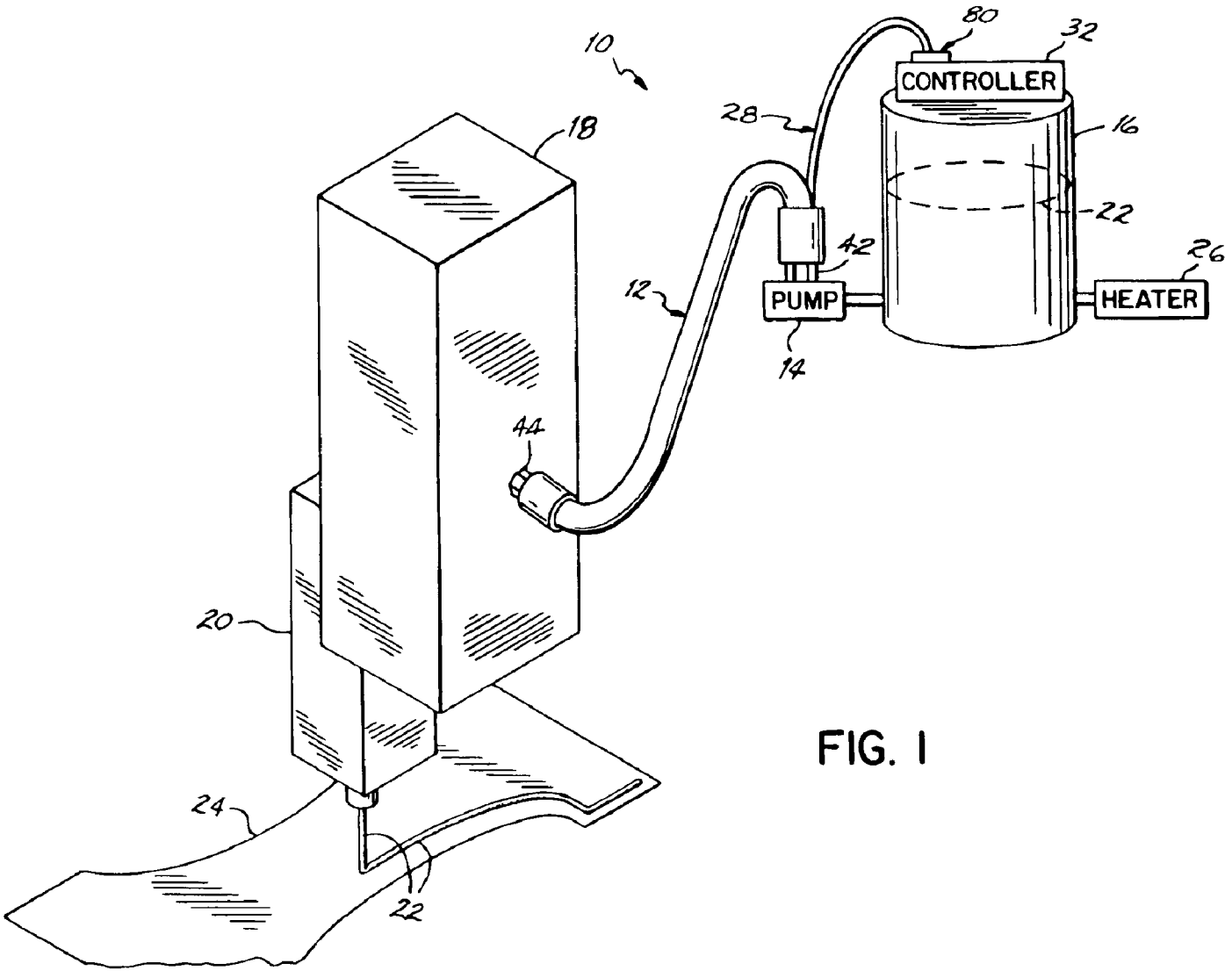
FIG. 1 is a perspective view of a heated hose constructed in accordance with the present invention and connecting a supply tank to an adhesive dispensing gun.

With reference to FIG. 1, an adhesive dispensing apparatus 10 includes a hose 12 constructed in accordance with the principals of the present invention. The hose 12 connects a pump 14, which is coupled to supply tank 16, to a manifold 18, which is coupled to an adhesive dispensing gun 20. As such, pump 14 can transport an adhesive 22, such as hot melt, for example, from supply tank 16 via hose 12 to adhesive dispensing gun 20. The adhesive dispensing gun 20 selectively dispenses adhesive 16 onto a substrate 24 such as a nonwoven web used in the construction of a diaper. A heater 26 is associated with supply tank 16 and is selectively controlled to maintain the adhesive 22 within supply tank 16 within a predetermined elevated temperature range. The hose 12 includes an wire harness 28 which is connected to a controller 32 associated with the supply tank 16.

Figure 2:
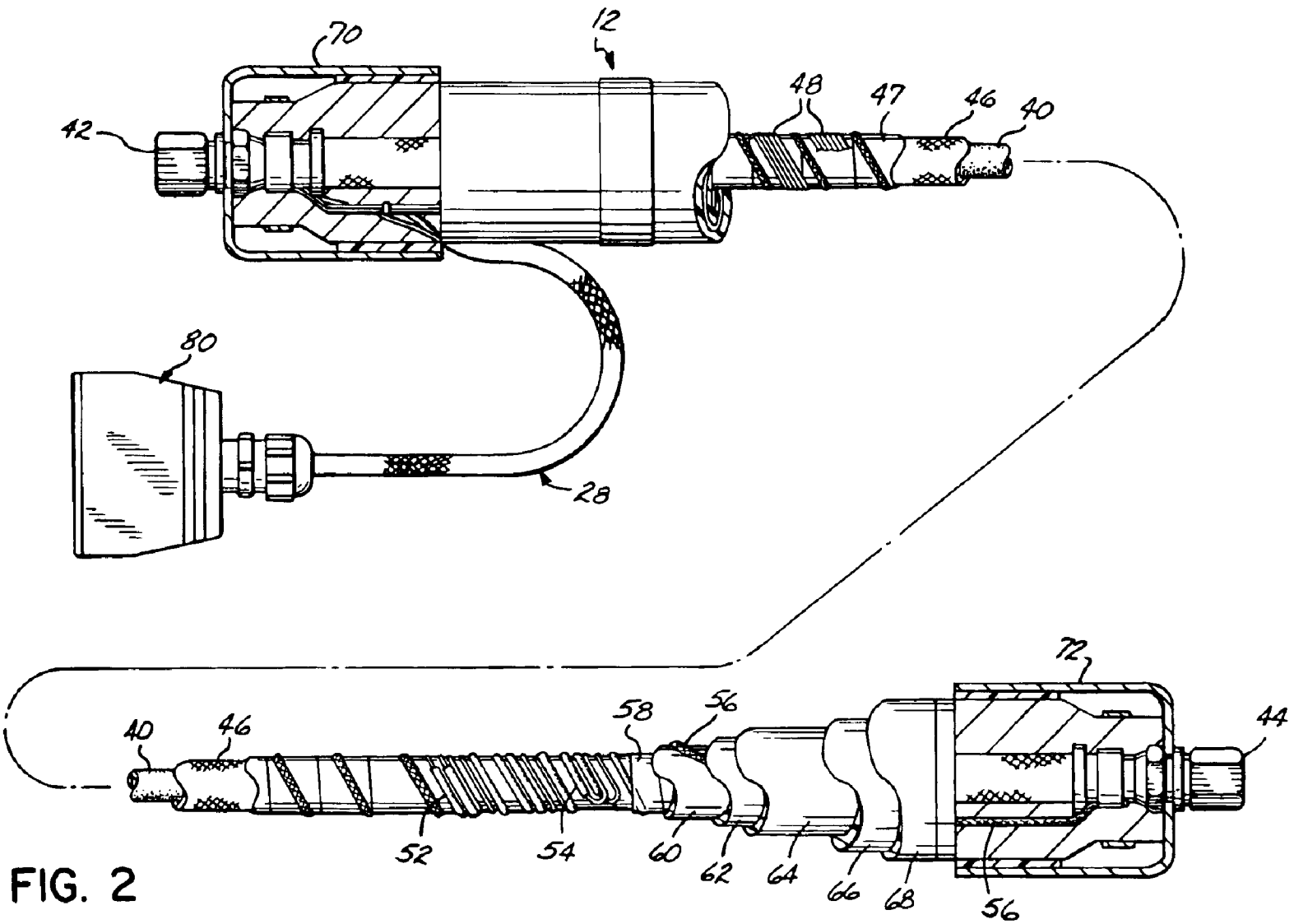
FIG. 2 is an enlarged partial cross-sectional plan view of the hose of FIG. 1.

With reference to FIG. 2, the hose 12 includes a tube 40 with an inlet end 42 which connects to pump 14 and a discharge end 44 which connects to manifold 18. The tube 40 is advantageously constructed of Teflon™ and is covered end to end by a steel braid cover 46. Steel braid cover 46 is wrapped by at least one layer of tape 47, preferably silicon tape. It is believed that the tape 47 helps to reduce abrasion which might occur if components were otherwise wrapped in direct contact with the steel braid cover 46. The hose 12 further includes an electrical heating device 48 which is wrapped around the steel braid cover 46 along substantially the entire length of the tube 40. One end of the heating device 48 is operatively connected to a connector 80 at the terminal end of wire harness 28. Two temperature sensing devices 52, 54 also wrap around the tube 40 and are operatively connected to connector 80. The temperature sensing devices 52, 54 are preferably resistance temperature detectors (RTD) which sense the temperature of the adhesive 22 flowing through tube 40. Alternatively, one or both of temperature sensing devices 52, 54 could be thermocouples or any other suitable temperature sensing device. Though the RTDs 52, 54 are not to be limited to any particular material, RTDs 52 may be constructed of nickel or platinum. For a given application, only one of the RTDs 52, 54 may be actively connected to controller 32 to monitor the temperature of the adhesive 22 flowing through the tube 40; the other RTD can remain inactive unless specifically activated in accordance with the invention as discussed further below. A ground wire 56 electrically connects inlet end 42 and discharge end 44 to connector 80 of wire harness 28.

An insulative tape 58 is wrapped around heating element 48, temperature sensing devices 52, 54, and ground wire 56. Three insulative layers 60, 62, 64 are wrapped around the insulative tape 58 to help reduce heat loss from the heated adhesive 22. Preferably, the insulative layers 60, 62, 64 are constructed of fiberglass. Another layer of tape 66, such as electrical tape, is wrapped around the outside of insulative layer 64. A braided plastic cover 68 covers the electrical tape 66 to provide a protective cover for the outside of the hose 12. Cuffs 70, 72 are placed over the respective inlet and discharge ends 42, 44 to provide additional protection to hose 12 and its electrical components against potentially damaging elements such as water. Preferably, cuffs 70, 72 are made from high temperature plastic.

It will be appreciated that the connector 80 may take on several different configurations as dictated, for example, by the configuration of the connector (not shown) of the controller 32. The controller 32 may not have a connector at all, but instead have a terminal strip in which individual wires of cable 28 are individually connected. In a simpler form of this invention, for example, a direct connection of RTD 52 may be substituted with a direct connection of RTD 54, or vice versa, when maintenance or repair is necessary. This would at least alleviate the need for more complicated disassembly and costly replacement of hose 12 in the event of failure or malfunction of one of the RTDs 52 or 54.

The controller 32 monitors the temperature preferably from only one of the two RTDs 52, 54 and operates the heating element 48 based on readings from that RTD to maintain a desired temperature. Alternatively, the controller may be monitoring temperature readings from both RTDs 52, 54. Monitoring both RTDs 52, 54 may be most beneficial when RTDs 52, 54 are positioned in different locations of the same heated component or device, such as hose 12. In either case, when one of the two RTDs 52, 54 is found to be malfunctioning or failing, that RTD is deactivated and the other RTD is activated or remains active to function within the heater control system. In such cases, the controller 32 sends an indication or warning to the operator that one of the RTDs 52 or 54 has malfunctioned. In one embodiment, only one of the two RTDs is electrically connected to the controller 32. When necessary, the other of the two RTDs is electrically connected either manually, such as through hard wiring on a terminal block (not shown), or automatically through a suitable relay or other control operation or circuit in the controller 32. Various manners may be used to detect the malfunctioning or failure of RTDs 52, 54. Typically, failures occur through electrical shorts or open RTD circuits (i.e., a severed wire). In such cases, the measured resistance associated with the RTD will be much lower or higher than the expected range and, therefore, the controller 32 will be able to determine if an active RTD has failed by comparing the measured resistance with the expected range.

The invention further contemplates that the controller 32 can cycle one or both RTDs 52, 54 on and off at any desired rate during operation of the component, device or system being heated. For example, if one of the RTDs 52 is the primary RTD and is being used for temperature control, while the other RTD 54 is a backup RTD to be used in the case of failure of primary RTD 52, then the controller could occasionally cycle backup RTD 54 "on" or into an activated state, or otherwise test RTD 54, in order to ensure that it is functional when needed upon malfunction or failure of the primary RTD 52. During such activation of backup RTD 54, primary RTD 52 may or may not be actively connected for temperature control purposes as well.

Figure 3:
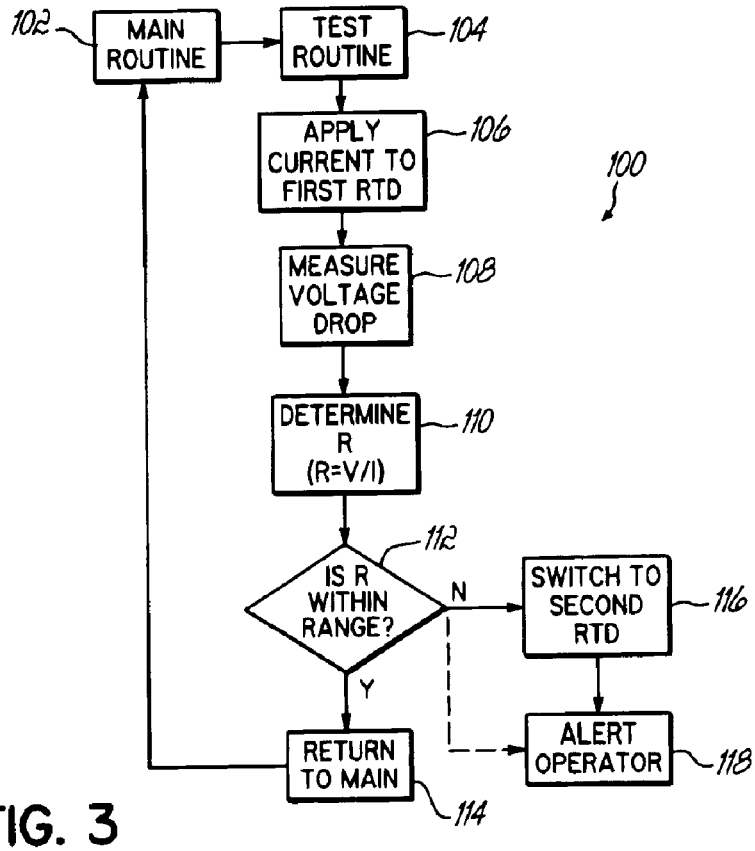
FIG. 3 is a flow chart illustrating a control routine according to the present invention.

Referring to FIG. 3, another manner of detecting a malfunctioning or failed RTD is disclosed. Flowchart 100 illustrates the process steps for a program or other suitable circuitry of controller 32 which can determine whether one of the two RTDs 52, 54 is malfunctioning or has otherwise failed. At appropriately determined times, controller 32 will switch from its main routine 102 to a test routine 104. While in the test routine, a known electrical current will be supplied to the active RTD (e.g., 52) which is being used to detect the temperature of the liquid flowing through hose 12. The voltage drop is then measured across the active RTD 52 as indicated by process step 108 and, in process 110, the resistance is determined by dividing the voltage drop by the applied current. The determined resistance is then compared to the specified range of resistances at process step 112 for that particular RTD by the RTD manufacturer, for example. If the resistance is within the specified range, then the controller 32 returns to the main routine 102. If the resistance is not within the specified range, then the controller 32 preferably switches to the second RTD 54 and deactivates the first RTD 52. The controller may also or alternatively alert the operator at process step 118 by, for example, activating a suitable light or sound, or both, or communicating with the operator in some other way such as via the internet or intranet. In this case, the alerted operator may simply be notified that the system is operating on the second or backup RTD 54, or in the case in which the controller 32 does not automatically switch to the second RTD 54, the operator may manually switch the controller over to the second RTD by, for example, hardwiring the second RTD to the controller input and disconnecting the first RTD from the controller input or in some other suitable manner. It will be appreciated that various other manners of determining whether the active RTD (that is, the RTD supplying temperature information to controller 32) is malfunctioning or failing may be used. These may include, for example, comparing the temperature readings supplied by the active RTD to other temperature readings taken from the same heated device or in other components in the same heated system.

Figure 4:
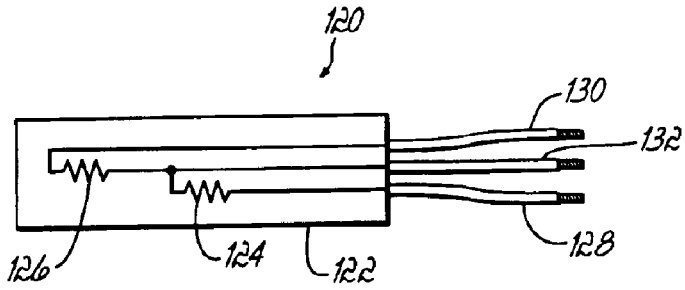
FIG. 4 is an elevational view of another embodiment of a redundant temperature sensing device of the present invention.

FIG. 4 illustrates another embodiment of a redundant temperature sensing device 120 constructed in accordance with the invention. This embodiment may be incorporated into various components of, for example, a hot melt adhesive dispensing system. Device 120 generally comprises a housing 122 carrying first and second temperature sensing devices 124, 126. Again, temperature sensing devices 124, 126 may comprise conventional RTDs as shown, or may alternatively comprise other forms of temperature sensing devices. Temperature sensing device 124 is connected to a first wire lead 128, while temperature sensing device 126 is connected to a second wire lead 130. Both temperature sensing devices 124, 126 are further electrically connected to a common wire lead 132. In this manner, redundant temperature sensing device 120 may be manually or automatically electrically coupled to a controller such as controller 32 in a manner which activates and uses signals generated from only one of the two temperature sensing devices or RTDs 124, 126 or from both.

Figure 5:
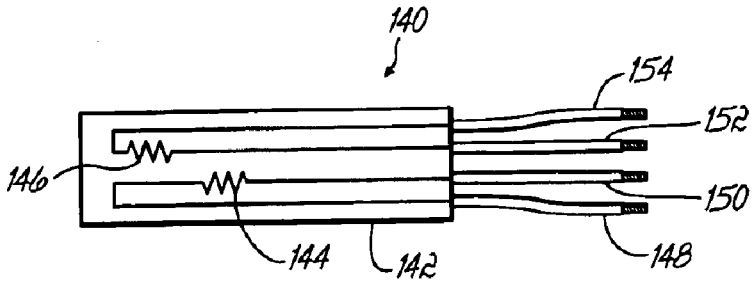
FIG. 5 is an elevational view of another embodiment of a redundant temperature sensing device of the present invention.

FIG. 5 illustrates another embodiment of a redundant temperature sensing device 140 constructed in accordance with the invention. This embodiment may also be incorporated into various components of, for example, a hot melt adhesive dispensing system. Device 140 generally comprises a housing 142 carrying first and second temperature sensing devices 144, 146. Again, temperature sensing devices 144, 146 may comprise conventional RTDs as shown, or may alternatively comprise other forms of temperature sensing devices. Temperature sensing device 144 is connected to first and second wire leads 148, 150, while temperature sensing device 146 is connected to separate first and second wire leads 152, 154. Redundant temperature sensing device 140 may be manually or automatically electrically coupled to a controller such as controller 32 in a manner which activates and uses signals generated from only one of the two temperature sensing devices or RTDs 144, 146 or from both.

Although hose 12 has been described herein as having multiple insulation and protective layers, the principles of the present invention are equally applicable to any hose construction having a tube and at least two temperature sensing devices operatively associated therewith. The hose 12 can be manufactured in a variety of predetermined lengths between 7 and 60 feet, although other lengths could be accommodated. The tube 40 preferably has an internal diameter of between about ⅜ inch to about ⅝ inch. It should also be appreciated that the present invention is also applicable to other heated devices for carrying liquids such as the various components in a hot melt adhesive dispensing system, i.e., dispensing guns, melters, manifolds, and other components or devices in the system.

Although hose 12 and redundant temperature sensing device 120 have been described above as having two temperature sensing devices which are preferably RTDs, the two temperature sensing devices could also be thermocouples or any other suitable temperature sensing device. In fact, the temperature sensing devices need not be of the same type. In other words, one temperature sensing device could be a thermocouple and the other temperature sensing device could be an RTD. Further, any number of RTDs and thermocouples could be part of the same heated device. Although hose 12 is shown having only one wire harness 28 extending therefrom to which RTDs 52, 54 are coupled, hose 12 could include a separate wire harness for each temperature sensing device operatively associated with hose 12. As such, an appropriate connector could connect to the appropriate wire harness depending on the specific RTD that would be active. The other wire harness would not be used and its associated RTD would be inactive until needed. In the case of using a single wire harness 28 and connector 80, the controller 32 could be automatically or manually programmed to read specific pins on the connector 80 depending on which RTD 52 or 54 was to be activated. A suitable adaptor plug could alternatively be used depending on which RTD 52 or 54 was to be actively coupled to the controller. It will be appreciated that many different hardware and/or software configurations may be used to carry out the inventive principles.

While the present invention has been illustrated by a description of various preferred embodiments and while these embodiments have been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims, wherein we claim:

What is claimed is:

1. A device for carrying a heated liquid, and controlling the temperature of the heated liquid, comprising:

a liquid conveying element including a passage for carrying the heated liquid, first and second temperature sensing devices operatively associated with said liquid conveying element to enable sensing the temperature of the heated liquid in said passage, a controller actively connected to said first temperature sensing device and not actively connected to said second temperature sensing device such that said first temperature sensing device senses the temperature of the heated liquid in said passage and communicates the sensed temperature to said controller, said second temperature sensing device capable of being actively connected to said controller upon failure or malfunction of said first temperature sensing device, said controller including a program capable of determining whether one of said first and second temperature sensing devices has failed or malfunctioned; and a heater coupled with said controller and operated by said controller based on the sensed temperature readings taken by said first temperature sensing device.

2. The device of claim 1, wherein said controller is configured to detect the failure or malfunction of said first temperature sensing device and provide indication thereof to an operator.

3. The device of claim 2, wherein said controller is further configured to automatically deactivate a malfunctioning or failed one of said first and second temperature sensing device.

4. The device of claim 1, wherein said liquid conveying element comprises a component in a hot melt adhesive dispensing system configured to carry a hot melt adhesive in said passage.

5. The device of claim 1, wherein said first and second temperature sensing devices are resistance temperature detectors.

6. The device of claim 2, wherein said controller is further configured to cycle at least one of said first and second temperature sensing devices on and off.

7. The device of claim 1, wherein said liquid conveying element is configured as a heated hose.

8. The device of claim 1, further comprising:

a supply tank adapted to hold the heated liquid;

a hose coupled to said supply tank and adapted to convey the heated liquid therethough;

a manifold coupled to said hose and adapted to distribute the heated liquid; and a dispenser coupled to said manifold and adapted to dispense the heated liquid.

* * * * *

UNITED STATES PATENT AND TRADEMARK OFFICE

CERTIFICATE OF CORRECTION

PATENT NO. : 7,084,377 B2
APPLICATION NO. : 10/698312
DATED : August 1, 2006
INVENTOR(S) : John M. Raterman et al.

It is certified that error appears in the above-identified patent and that said Letters Patent is hereby corrected as shown below:

Column 7

Claim 1 line 30 through column 8 line 11 should read as folllow s:

1. A device for carrying a heated liquid, and controlling the temperature of the heated liquid, comprising:

a liquid conveying element including a passage for carrying the heated liquid, first and second temperature sensing devices operatively associated with said liquid conveying element to enable sensing the temperature of the heated liquid in said passage, a controller actively connected to said first temperature sensing device and actively connected to said second temperature sensing device such that said first and second temperature sensing devices sense the temperature of the heated liquid in said passage and communicate the sensed temperature readings to said controller, said first and second temperature sensing devices capable of being selectively deactivated upon failure or malfunction such that said controller only communicates with the remaining actively connected one of said first and second temperature sensing devices; and a heater coupled with said controller and operated by said controller based on the sensed temperature readings taken by at least one of said first and second temperature sensing devices.

Signed and Sealed this

Second Day of January, 2007

JON W. DUDAS
*Director of the United States Patent and Trademark Office*